US006066820A

United States Patent [19]

Niklaus

[11] Patent Number: 6,066,820

[45] Date of Patent: May 23, 2000

[54] SPRING DRIVE MECHANISM FOR SWITCHGEAR, IN PARTICULAR A CIRCUIT BREAKER

[75] Inventor: Rolf Niklaus, Unterentfelden, Switzerland

[73] Assignee: GEC Alsthom AG, Oberentfelden

[21] Appl. No.: 09/189,971

[22] Filed: Nov. 12, 1998

[30] Foreign Application Priority Data

Nov. 13, 1997 [FR] France ..... 97 14223

[51] Int. Cl.[7] ..... H01H 3/40

[52] U.S. Cl. ..... 200/501; 200/400

[58] Field of Search ..... 200/17 R, 400, 200/401, 500, 501; 218/1, 7, 14, 84, 92, 120, 140, 153, 154

[56] References Cited

U.S. PATENT DOCUMENTS

| | | | |
|---|---|---|---|
| 4,095,676 | 6/1978 | Howe et al. | 185/40 R |
| 4,681,993 | 7/1987 | Kondo et al. | 200/153 SC |
| 5,113,056 | 5/1992 | Kuhn | 200/400 |
| 5,541,378 | 7/1996 | Niklaus | 200/400 |

FOREIGN PATENT DOCUMENTS

| | | | |
|---|---|---|---|
| 0 294 561 A2 | 12/1988 | European Pat. Off. | H01H 3/30 |
| 0 651 409 A1 | 5/1995 | European Pat. Off. | H01H 3/30 |

*Primary Examiner*—Michael A Friedhofer
*Attorney, Agent, or Firm*—Sughrue, Mion, Zinn, Macpeak & Seas, PLLC

[57] ABSTRACT

A spring drive mechanism for switchgear, in particular for a circuit breaker. The mechanism has an engagement shaft that is rotatable about its axis, a large toothed-wheel mounted on said shaft, a small toothed-wheel meshing with said large toothed-wheel to put an engagement spring under stress, and a mechanism which prevents the large toothed-wheel and the small toothed-wheel jamming each other mutually after the shaft has been released. The mechanism which prevents jamming includes the shape of the teeth of said small toothed-wheel and the shape of the teeth of the large toothed-wheel. In the teeth of the large toothed-wheel there is a first gap followed, in the direction of rotation, by a first retractable tooth that is retractable along the axis of the tooth against bias from a spring. This tooth is followed by a second gap extending over a length that is not less than two gear pitch steps and is slightly less than an integer number of steps. The tooth immediately following said second gap is a second retractable tooth retractable along its axis against bias from a spring. Each of the retractable teeth and the first non-retractable tooth following the last retractable tooth has flanks that meet radially outwards at a common edge, and includes an inclined plane in its top zone adjacent to the edge.

20 Claims, 6 Drawing Sheets

SPRING DRIVE MECHANISM FOR SWITCHGEAR, IN PARTICULAR A CIRCUIT BREAKER

FIELD OF THE INVENTION

The present invention relates to a spring drive mechanism for power switchgear, in particular for a medium or high voltage power switch, and in particular a circuit breaker, the mechanism comprising:

an engagement spring eccentrically coupled to an engagement shaft that is free to rotate about its axis, said spring being organized to entrain firstly the engagement shaft in a predetermined direction of rotation to put the switchgear into circuit, and secondly a large toothed-wheel mounted on the engagement shaft and a small toothed-wheel which meshes with said large toothed-wheel and which is coupled to a drive member for driving, by means of said small toothed-wheel, said large toothed-wheel and said engagement shaft in said predetermined direction to stress the engagement spring for the purpose of putting the switchgear into circuit, said engagement shaft being organized to pass from a position in which the engagement spring is relaxed, at least in part, to beyond a dead-center position in which the engagement spring is under stress;

a pawl mechanism organized to bear against the large toothed-wheel in a bearing position situated beyond the dead-center position in the predetermined direction of rotation and to release said engagement shaft to put said switchgear into circuit;

a first gap formed in the periphery of said large toothed-wheel and generated by a discontinuity in the teeth of said large toothed-wheel, said gap being provided in a zone of the teeth which is situated close to said small toothed-wheel when the engagement shaft is bearing against the pawl mechanism; and means for preventing the large toothed-wheel and the small toothed-wheel from mutually jamming each other after the engagement shaft has been released by the pawl mechanism, said means comprising:

a shape for the teeth of said small toothed-wheel in which the flanks of a tooth meet radially outwards at a common edge and present, on the leading flank, an involute shape, and on the opposite flank, a flank plane extending from the edge and inclined relative to a radial straight line passing through the middle of the tooth; and a shape for the tooth of the large toothed-wheel that follows the gap in said predetermined direction, in which its flanks meet radially outwards at a common edge, and which include an inclined plane in the top zone adjacent to the edge.

BACKGROUND OF THE INVENTION

The European patent application published under the number 0 651 409 A1 describes a mechanism of this type. In that embodiment, all the teeth of the small toothed-wheel and the first tooth which follows, in the predetermined direction, the gap left by the discontinuity in the teeth of the large toothed-wheel are configured in such a manner that for each of them their flanks converge towards a single edge. The purpose of that measure is to prevent the toothed wheels jamming. Unfortunately, it turns out that the friction of an edge of a small toothed-wheel on the leading flank of the first tooth following the gap in the large toothed-wheel gives rise to power losses of greater or lesser size due to the rubbing. Such losses which depend on the position of the small toothed-wheel give rise to variations in the time required for engaging the switchgear and also to non-negligible wear of the first tooth following the gap in the large toothed-wheel. If the mechanism is used to control a switch that is designed to reduce network surges by being engaged synchronously with the voltage on the network, then such randomly-appearing variations are unacceptable.

European patent No. 0 294 561 A2 describes a drive mechanism of a similar type, coupled to a disconnector and in which the first tooth of the large toothed-wheel situated immediately after the gap is radially retractable against the bias of a compression spring. If this tooth comes into abutment against the tip of a tooth of the small toothed-wheel at the beginning of the engagement process, it retracts radially, compressing the spring that is associated therewith. As a result, the tooth can slide without jamming on the edge of the corresponding tooth of the small toothed-wheel. Once it has gone past this edge, it engages in the space following the tooth of the small toothed-wheel. Nevertheless, there is a major risk of the retractable tooth continuing to entrain the large toothed-wheel by friction, in spite of being progressively retracted into the housing which contains the spring. Under such circumstances, the second tooth following the gap provided in the large toothed-wheel, and which is not retractable, can come into abutment against the edge of a tooth of the small toothed-wheel and jam the entire gear mechanism. This probability is high since the small toothed-wheel is decoupled from its drive by a freewheel coupling, and can therefore turn very easily.

OBJECTS AND SUMMARY OF THE INVENTION

The present invention seeks to remedy the above drawbacks and to avoid any risk of such known mechanisms operating wrongly by providing a solution that is effective, easy to implement, and which can also be retrofitted by appropriate modification to mechanisms of this type which are already in service.

This object is achieved by the mechanism as defined in the preamble, wherein said first gap formed in the periphery of said large toothed-wheel is followed in said predetermined direction of rotation by a first retractable tooth retractable along the axis of the tooth against bias from a compression spring, wherein said first retractable tooth is followed in said predetermined direction of rotation by a second gap formed in the periphery of said large toothed-wheel, generated by an additional discontinuity in its teeth, said second gap extending over at least two gear pitch steps, and wherein the tooth immediately following said second gap is a second retractable tooth that is retractable along the axis of the tooth against the bias of a compression spring.

In a preferred embodiment, said second gap extends over a length that is slightly less than an integer number of gear pitch steps, and said second retractable tooth has flanks which meet radially outwards at a common edge and which include an inclined plane in its top zone adjacent to the edge.

Advantageously, said second gap extends over a length that is approximately one-sixth of a gear pitch step shorter than an integer number of gear pitch steps and preferably over a length that is approximately equal to 2% of a gear pitch step.

Particularly advantageously, said second retractable tooth is followed in said predetermined direction of rotation by a third gap which extends over at least two gear pitch steps.

Preferably, said third gap is followed by a tooth whose flanks meet radially outwards at a common edge, and which includes an inclined plane in its top zone adjacent to the edge.

More generally, said first gap is followed in the predetermined direction of rotation by n retractable teeth that are retractable along the axis of the tooth against spring bias, each of the retractable teeth being followed in said predetermined direction of rotation by a gap extending over at least two gear pitch steps.

In all embodiments, each of said retractable teeth and the first non-retractable tooth following the last retractable tooth in the predetermined direction of rotation has flanks which meet radially outwards at a common edge, and includes an inclined plane in its top zone adjacent to the edge.

Advantageously, each of said retractable teeth is spaced apart from each adjacent retractable tooth by a gap extending over a length that is slightly less than an integer number of gear pitch steps.

BRIEF DESCRIPTION OF THE DRAWINGS

The present invention will be better understood on reading the following description of a preferred embodiment made with reference to the corresponding drawings given as non-limiting examples, in which.

MORE DETAILED DESCRIPTION

Figure 1:
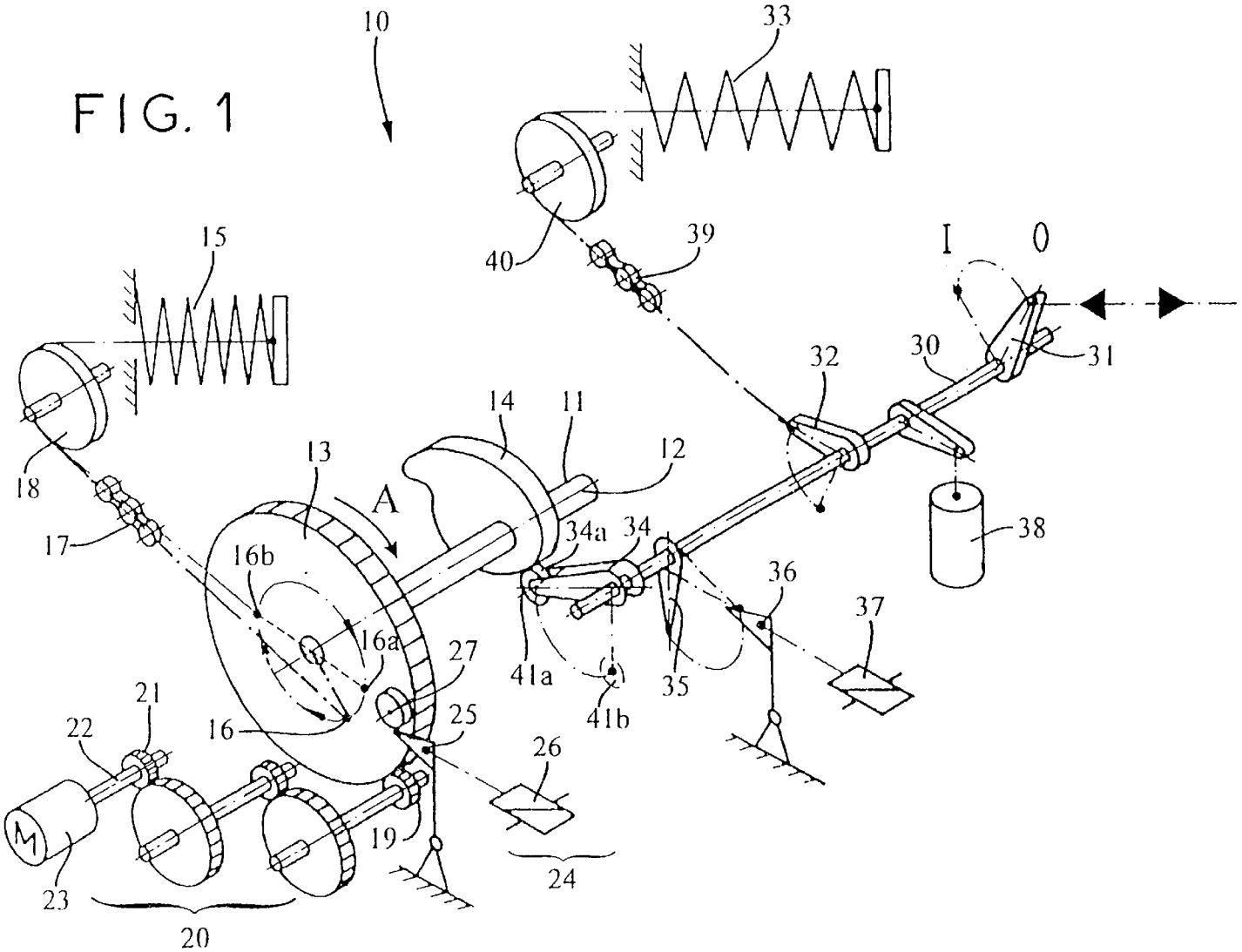
FIG. 1 is a diagrammatic overall view showing a preferred embodiment of the mechanism of the invention.

With reference to FIG. 1, the spring drive mechanism 10 as shown for coupling to switchgear comprises an engagement shaft 11 that is free to rotate about its axis 12 and that carries firstly a large toothed-wheel 13 and secondly a cam 14 whose function is explained below. An engagement spring 15 constituted by a traction spring is coupled to the large toothed-wheel 13 at an attachment point 16 by means of a chain 17 or by any other appropriate means, passing over a deflector pulley 18 in the example shown. The large toothed-wheel 13 meshes with a small toothed-wheel 19 which is coupled via a gear train 20 to a driving pinion 21 secured to an outlet shaft 22 of a drive motor 23.

This set of components of the mechanism is known per se and is described in detail in the European patent application published under the Number 0 652 409 mentioned in the preamble, and it is intended to enable the engagement spring 15 to drive the engagement shaft 11 in a predetermined direction of rotation A (see arrow A in FIG. 1) in order to put the switchgear into circuit (not shown), and to enable the drive motor 23 to put the engagement spring 15 under stress so that it is cocked and ready to release its accumulated energy so as to be ready at all times to put the switchgear into circuit. When the switchgear is engaged, the engagement spring 15 exerts traction on the chain 17 and causes the large toothed-wheel 13 to rotate in the predetermined direction shown by arrow A, with the attachment point 16 passing from a ready position situated slightly downstream from a dead-center point 16*a* (in the predetermined direction of rotation A for the large toothed-wheel), to a final position corresponding to a relaxation point 16*b* which is diametrically opposite the dead-center point 16*a*. Thereafter, the drive motor 23 takes over to drive the engagement shaft 11 so that it rotates in the predetermined direction of rotation A. This continues until the engagement spring attachment point has again gone slightly past the dead-center point 16*a* and the spring is cocked. The large toothed-wheel is stopped in this position by a pawl mechanism 24 having a pawl 25 actuated by an electromagnet 26 and an abutment 27 mounted on one of the faces of the large toothed-wheel 13, which abutment co-operates with the pawl 25 to hold the wheel in the desired ready position.

The mechanism 10 also has a main shaft 30 carrying, in particular, an actuator lever 31 for actuating a handle (not shown) of the switchgear, a coupling lever 32 for coupling said shaft to a disengagement spring 33, a cam-follower lever 34 carrying a cam-follower wheel 34*a* which co-operates with the cam 14, a locking lever 35 which co-operates with a pawl 36 actuated by an electromagnet 37, and a brake lever which is coupled to a brake 38 constituted, for example, by a hydraulic shock absorber or the like. The disengagement spring 33 is preferably identical or similar to the engagement spring 15 and is connected by means of a chain 39 guided by a deflector pulley 40 to the coupling lever 32. The cam-follower wheel 34*a* is pressed against the cam 14 mounted on the engagement shaft 11. This cam controls the movement of the lever 34 between two positions 41*a* and 41*b* which correspond respectively to the positions I and O of the actuator lever 31. The pawl 36 locks the locking lever 35 in a position which corresponds to the actuator lever 31 being in its position I.

Figure 2:
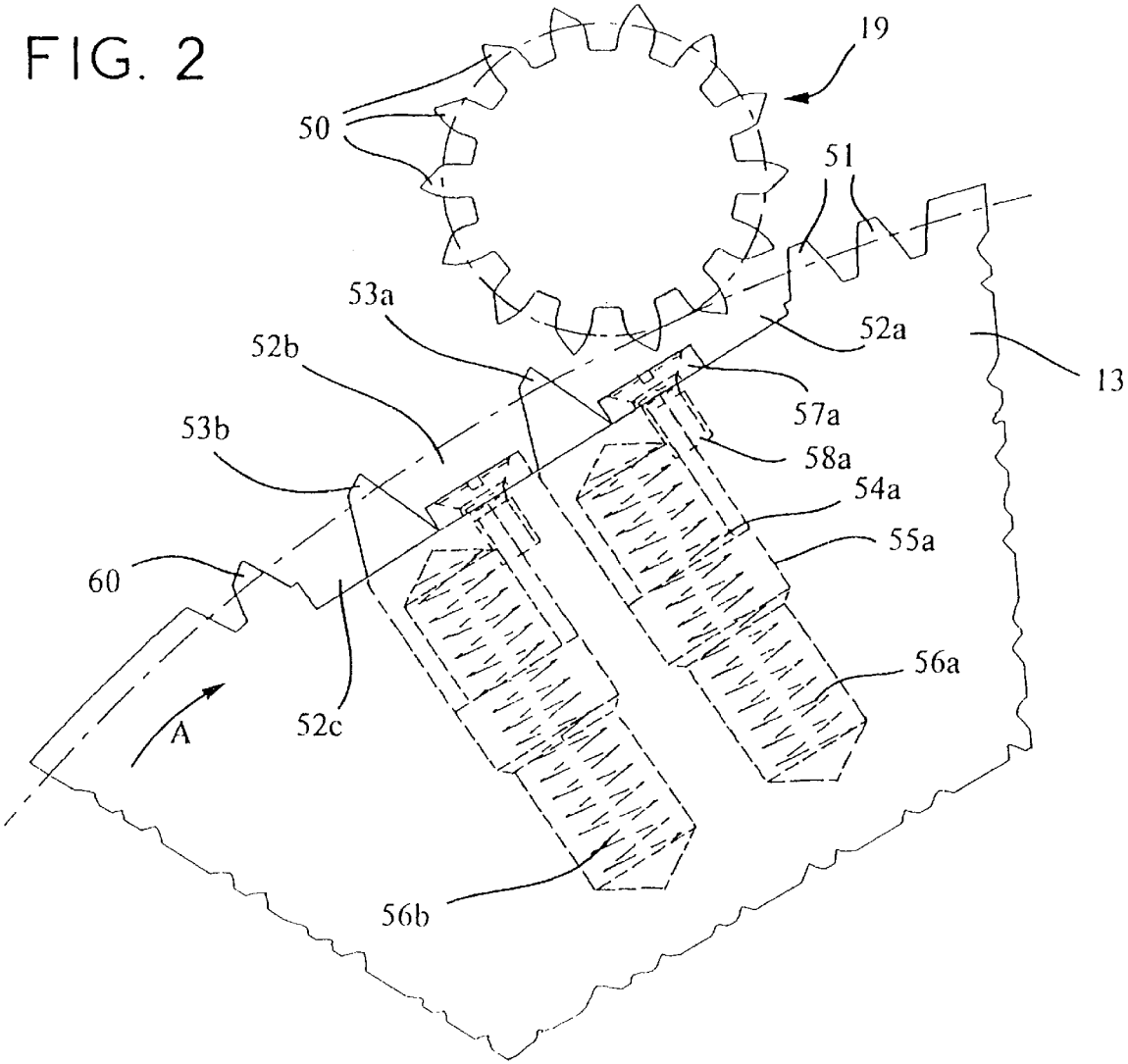
FIG. 2 is a detail view showing more specifically the retractable teeth of the large toothed-wheel.

FIG. 2 shows on a larger scale a portion of the large toothed-wheel 13 and the small toothed-wheel 19. It will be observed that the teeth 50 of the small toothed-wheel 19 are of a special shape, each being cut to a pointed tip. The flanks of each of these teeth meet radially outwardly on a common edge, and present on the leading flank an involute shape and on the opposite flank a plane going from the edge and sloping relative to a radial line passing through the middle of the corresponding tooth.

In the predetermined direction of rotation A, the large toothed-wheel 13 has a discontinuity in its teeth 51, said discontinuity giving rise to a first gap 52*a* constituting a zone without teeth. A first retractable tooth 53*a* is disposed in the gap. It is integral with a partially hollowed-out root 54*a* which is received in a substantially cylindrical socket 55*a* formed in the thickness of the large toothed-wheel. A compression spring 56*a* is mounted in the closed space defined between the cavity in the hollowed-out root 54*a* and the socket 55*a* in the wheel, the spring tending to urge the tooth 53*a* radially out from the wheel. To prevent the tooth escaping and to limit its outward stroke, a stop plate 57*a* is fixed in the bottom of the first gap 52*a* so as to close the socket 55*a* in part. This stop plate is fixed by means of at least one, and preferably two, fixing screws 58*a*. Because of this assembly, the tooth 53*a* can retract in part into the socket 55*a* against the stress exerted by the compression spring 56*a*.

Following the first retractable tooth 53*a*, the large wheel 13 has a second gap 52*b* formed by an additional discontinuity in the teeth 51 of this wheel. This second gap extends over at least two gear pitch steps. In a preferred embodiment, this gap extends over a length that is slightly shorter than an integer number of gear pitch steps, and advantageously over an integer number minus one-sixth of a gear pitch step, e.g. 2⅚ gear pitch steps.

The tooth 53*b* of the large toothed-wheel immediately following said second gap 52*b* is also retractable against the bias of a compression spring 56*b*. The tooth 60 following the second retractable tooth 53*b*, after a third gap 52*c* which extends over a length equal to an integer number of gear pitch steps, comprises, as do each of the retractable teeth, flanks which meet radially outwards on a common edge. The flank opposite to the leading flank has an inclined plane in its top portion adjacent to the edge of the tooth. In general, the two retractable teeth 53*a* and 53*b* can project proud relative to the other teeth 51 of the large toothed-wheel, thereby providing the advantage of reducing the probability of the tips of said other teeth coming into contact with the tip of a tooth of the small toothed-wheel 19.

Figure 3A:
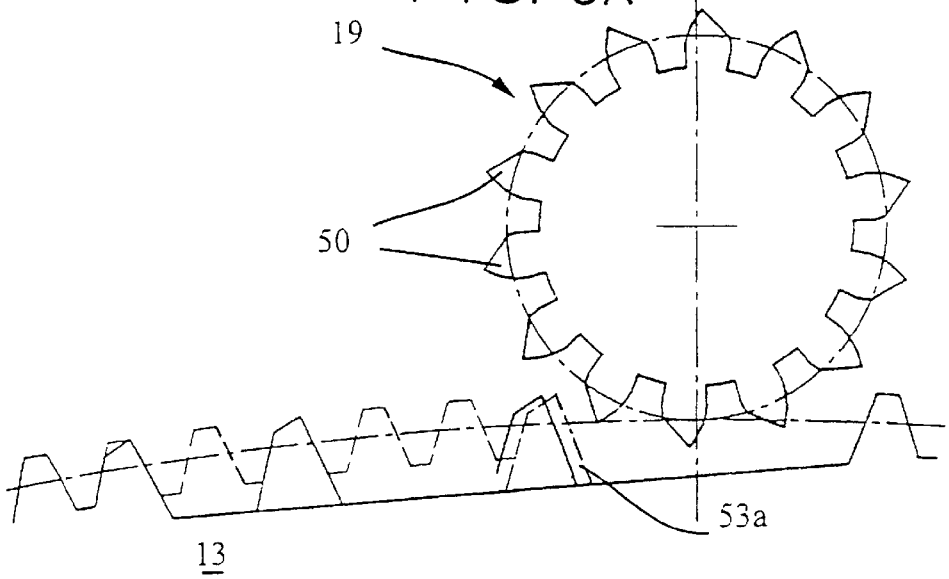
FIGS. 3A, 3B, 3C, 3D, 3E, 3F, 3G, and 3H show the behavior of the large toothed-wheel and of the small toothed-wheel in the zone where the retractable teeth mesh with the teeth of the small toothed-wheel when the teeth of the small toothed-wheel and the teeth of the large toothed-wheel do not come into collision.
Figure 3B:
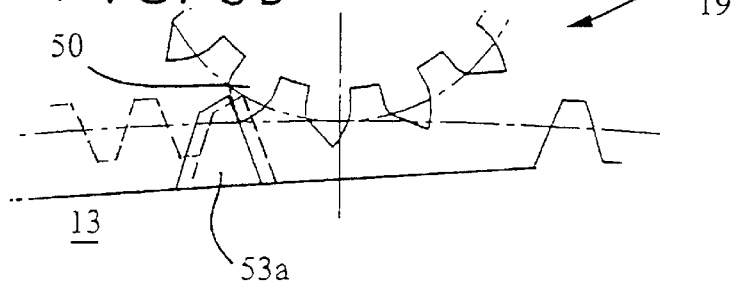
Figure 3C:
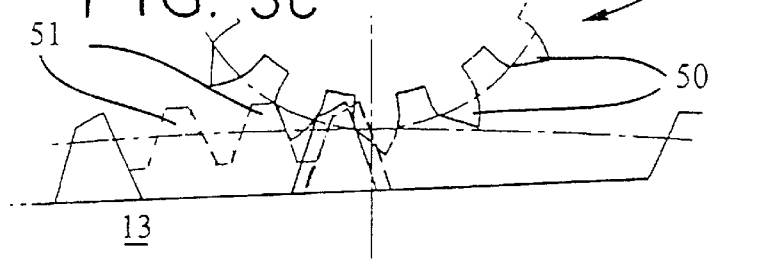
Figure 3D:
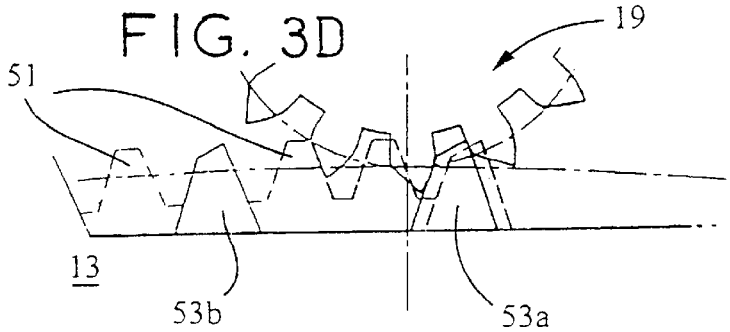
Figure 3E:
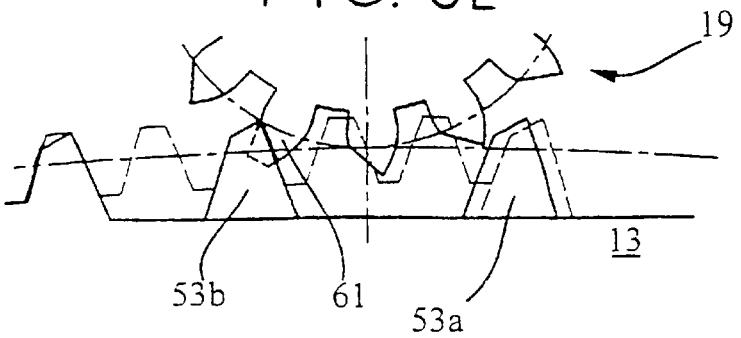
Figure 3F:
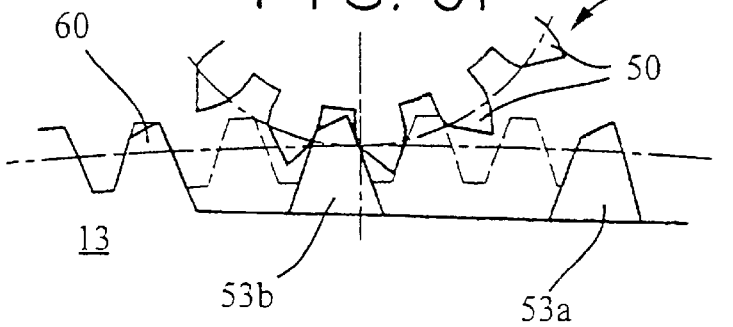
Figure 3G:
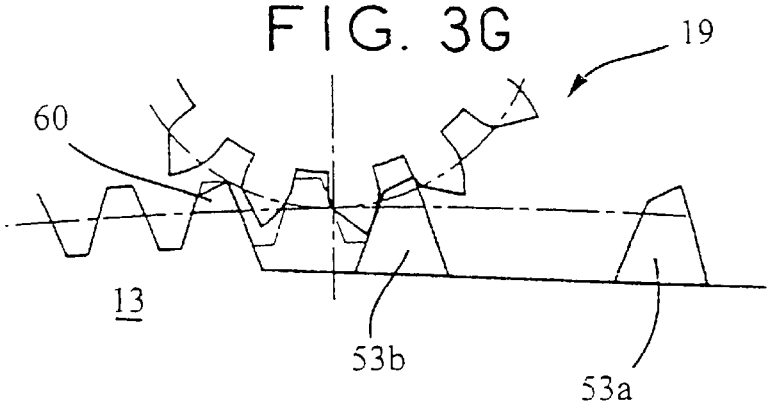
Figure 3H:
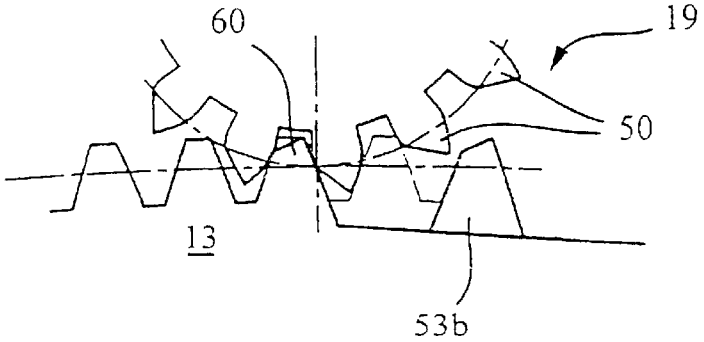

FIGS. 3A to 3H show what happens in the absence of collision between the teeth 50 of the small toothed-wheel 19 and the teeth of the large toothed-wheel 13. The initial instant is shown in FIGS. 3A and 3B, with FIG. 3B showing the instant of contact being made between a tooth of the small toothed-wheel 19 and the first retractable tooth 53*a* of the large toothed-wheel 13. FIGS. 3C and 3D show the positions of the teeth of the small toothed-wheel relative to the missing teeth 51 (represented by dashed lines) of the large toothed-wheel 13. FIG. 3E shows in dashed lines the original shape of a tooth 61 of the small toothed-wheel 19 that has not been cut in appropriate manner. It can be seen in this figure that had the original shape been maintained, it would automatically have given rise to a collision with the second retractable tooth 53*b* of the large toothed-wheel. FIGS. 3F, 3G, and 3H show the relative positions of the teeth 50 of the small toothed-wheel 19 and the teeth 53*a*, 53*b*, and 60 of the large toothed-wheel 13.

Figure 4A:
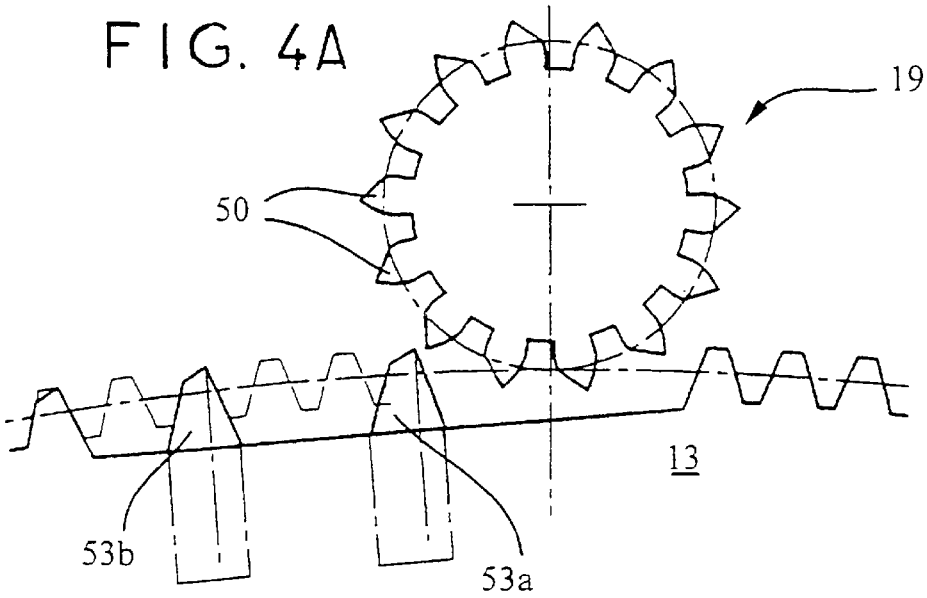
FIGS. 4A, 4B, 4C, 4D, 4E, 4F, 4G, and 4H show the behavior of the large toothed-wheel and of the small toothed-wheel in the zone where the retractable teeth mesh with the teeth of the small toothed-wheel when the teeth of the small toothed-wheel and the teeth of the large toothed-wheel come into collision.
Figure 4B:
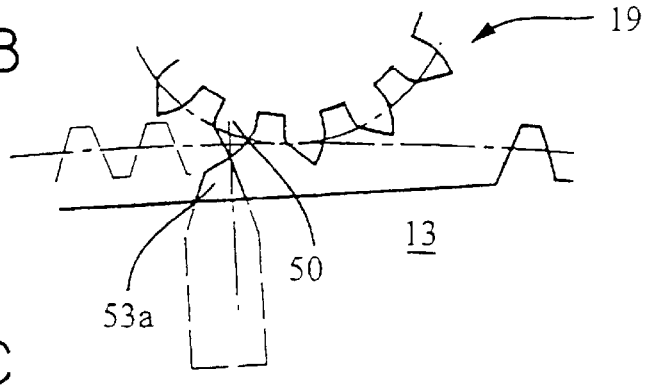
Figure 4C:
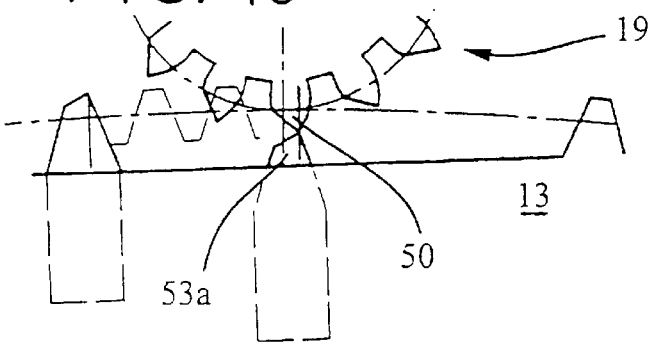
Figure 4D:
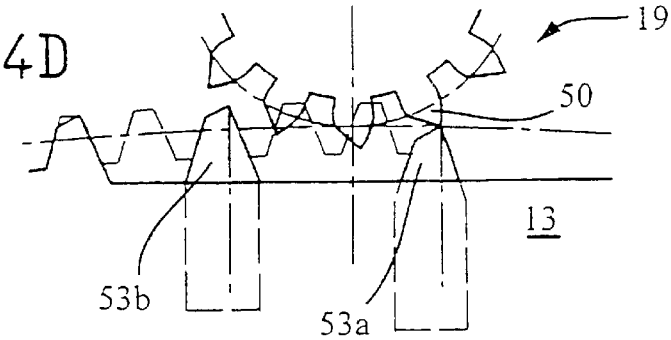
Figure 4E:
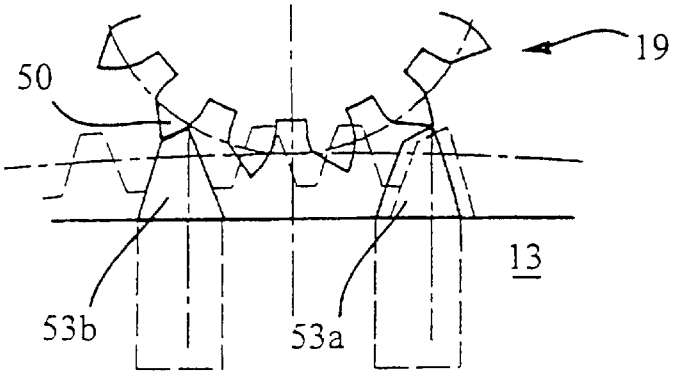
Figure 4F:
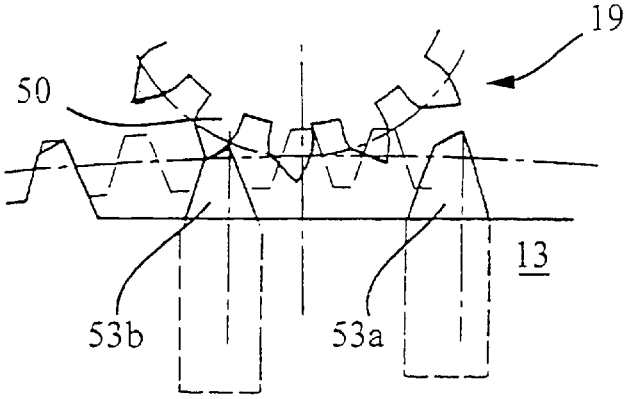
Figure 4G:
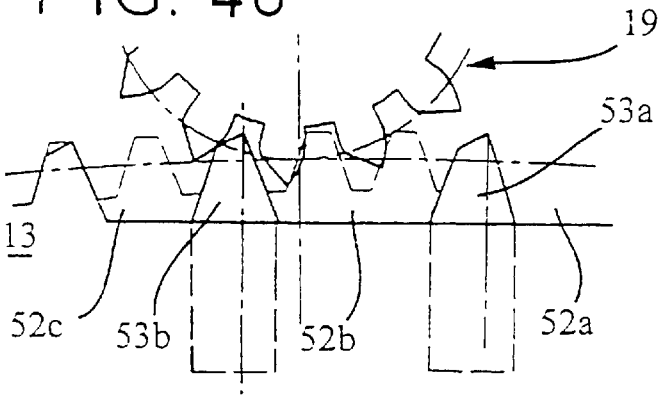
Figure 4H:
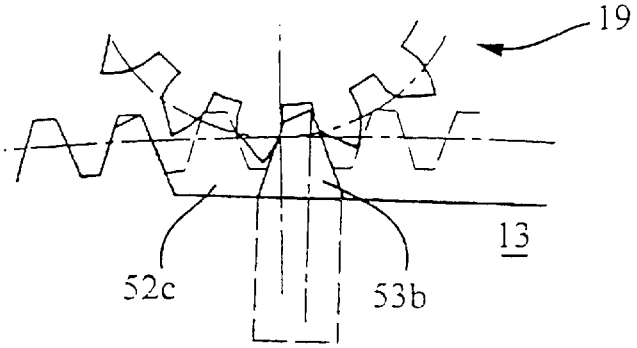

FIGS. 4A to 4H show what happens when the tip of a tooth 50 of the small toothed-wheel 19 meets the tip of the retractable tooth 53*a* of the large toothed-wheel 13. The initial instant of this contact between the two teeth 50 and 53*a* is shown in FIG. 4B. Tip-on-tip contact causes the tooth 53*a* to retract. As the movement continues, the teeth of the small toothed-wheel and the teeth of the large toothed-wheel take up relative positions as shown in FIGS. 4C and 4D. FIG. 4E shows contact between one of the teeth 50 of the small toothed-wheel 19 and the second retractable tooth 53*b*. This tooth retracts as shown in FIG. 4F, and then the two toothed-wheels mesh normally as shown in FIGS. 4G and 4H because of the gaps 52*a*, 52*b*, and 52*c* provided between the retraceable teeth 53*a*, 53*b* and after the second retraceable tooth.

The invention is not limited to the embodiments shown which merely constitute structural examples. In particular, the number of retractable teeth is not limited to two and may extend to three or n teeth that are retractable along the axis of the tooth against bias from a thrust spring, each of the teeth being followed by a gap as defined above.

What is claimed is:

1. A spring drive mechanism for power switchgear, the mechanism comprising:

an engagement spring eccentrically coupled to an engagement shaft that is free to rotate about an axis, said spring being organized to entrain firstly the engagement shaft in a predetermined direction of rotation to put the switchgear into circuit, and secondly a large toothed-wheel mounted on the engagement shaft and a small toothed-wheel which meshes with said large toothed-wheel and which is coupled to a drive member for driving, by said small toothed-wheel, said large toothed-wheel and said engagement shaft in said predetermined direction to stress the engagement spring for the purpose of putting the switchgear into circuit, said engagement shaft being organized to pass from a position in which the engagement spring is relaxed, at least in part, to beyond a dead-center position in which the engagement spring is under stress;

a pawl mechanism organized to bear against the large toothed-wheel in a bearing position situated beyond the dead-center position in the predetermined direction of rotation and to release said engagement shaft to put said switchgear into circuit;

a first gap formed in the periphery of said large toothed-wheel and generated by a discontinuity in the teeth of said large toothed-wheel, said gap being provided in a zone of the teeth which is situated close to said small toothed-wheel when the engagement shaft is bearing against the pawl mechanism; and means for preventing the large toothed-wheel and the small toothed-wheel from mutually jamming each other after the engagement shaft has been released by the pawl mechanism, said means comprising:

the teeth of said small toothed-wheel, wherein each tooth includes a leading flank, and an opposite flank, and each of said teeth is shaped so that the leading flank and opposite flank meet radially outwards at a common edge and present, on the leading flank, an involute shape, and on the opposite flank, a flank plane extending from the common edge and inclined relative to a radial straight line passing through the middle of the tooth;

a first retractable tooth on the large toothed-wheel, wherein said first retractable tooth follows the first gap in said predetermined direction and includes flanks and a top zone, wherein said flanks meet radially outwards at a common edge, said first retractable tooth being shaped so that it includes an inclined plane in the top zone adjacent to the common edge, wherein said first retractable tooth is retractable, along a radial axis extending through the first retractable tooth, against bias from a compression spring;

a second gap formed in the periphery of said large toothed-wheel, said second gap following said first retractable tooth in said predetermined direction of rotation and being generated by an additional discontinuity in the teeth of said large toothed-wheel, said second gap extending over at least two gear pitch steps; and a second retractable tooth following said second gap, said second retractable tooth being retractable, along a radial axis extending through the second retractable tooth, against the bias of a second compression spring.

2. A mechanism according to claim 1, wherein said second gap extends over a length that is slightly less than an integer number of gear pitch steps, and wherein said second retractable tooth has flanks which meet radially outwards at a second-retractable-tooth common edge, said second retractable tooth further including an inclined plane in a top zone adjacent to the second-retractable-tooth common edge.

3. A mechanism according to claim 2, wherein said second gap extends over a length that is approximately one-sixth of a gear pitch step shorter than an integer number of gear pitch steps.

4. A mechanism according to claim 3, wherein said second gap extends over a length that is approximately equal to 2⅚ of a gear pitch step.

5. A mechanism according to claim 3, wherein said second retractable tooth is followed in said predetermined direction of rotation by a third gap which extends over at least two gear pitch steps.

6. A mechanism according to claim 5, wherein said third gap is followed by a third tooth whose flanks meet radially outwards at a third-tooth common edge, said third tooth further including an inclined plane in a top zone adjacent to the third-tooth common edge.

7. A mechanism according to claim 1, wherein said first gap is followed in the predetermined direction of rotation by n retractable teeth, each of the retractable teeth being retractable along a radial axis extending through that tooth against spring bias, each of the retractable teeth being followed in said predetermined direction of rotation by a gap extending over at least two gear pitch steps.

8. A mechanism according to claim 7, said large toothed-wheel further including a first non-retractable tooth following the $n^{th}$ retractable tooth in the predetermined direction, wherein each of said retractable teeth and the first non-retractable tooth has flanks which meet radially outwards at a common edge, and includes an inclined plane in a top zone adjacent to the common edge.

9. A mechanism according to claim 8, wherein each one of said n retractable teeth is spaced apart from adjacent retractable teeth by a gap extending over a length that is slightly less than an integer number of gear pitch steps.

10. A spring drive mechanism for power switchgear, the mechanism comprising:

a small toothed-wheel;

a large toothed-wheel which meshes with said small toothed wheel, said large toothed wheel including a first gap formed in the periphery of the large toothed-wheel and generated by a discontinuity in the teeth of the large toothed-wheel; and a mechanism which prevents the large toothed-wheel and the small toothed-wheel from mutually jamming each other when said large toothed-wheel rotates in a predetermined direction, said mechanism comprising:

the teeth of said small toothed-wheel, wherein each tooth includes a leading flank, and an opposite flank, and each of said teeth is shaped so that the leading flank and opposite flank meet radially outwards at a common edge and present, on the leading flank, an involute shape, and on the opposite flank, a flank plane extending from the common edge and inclined relative to a radial straight line passing through the middle of the tooth;

a first retractable tooth on the large toothed-wheel, wherein said first retractable tooth follows the first gap in said predetermined direction and includes flanks and a top zone, wherein said flanks meet radially outwards at a first-retractable-tooth common edge, said first retractable tooth being shaped so that it includes an inclined plane in the top zone adjacent to the first-retractable-tooth common edge, wherein said first retractable tooth is retractable, along a radial axis extending through the first retractable tooth, against bias from a compression spring;

a second gap formed in the periphery of said large toothed-wheel, said second gap following said first retractable tooth in said predetermined direction of rotation and being generated by an additional discontinuity in the teeth of said large toothed-wheel, said second gap extending over at least two gear pitch steps; and a second retractable tooth following said second gap, said second retractable tooth being retractable, along, a radial axis extending through thee second retractable tooth, against the bias of a second compression spring.

11. A mechanism according to claim 10, further comprising:

an engagement spring eccentrically coupled to an engagement shaft that is free to rotate about an axis, said large toothed-wheel being mounted on said engagement shaft, said spring being organized to entrain firstly the engagement shaft in the predetermined direction of rotation to put the switchgear into circuit, and to entrain secondly the large toothed-wheel and the small toothed-wheel which is coupled to a drive member for driving, by said small toothed-wheel, said large toothed-wheel and said engagement shaft in said predetermined direction to stress the engagement spring for the purpose of putting the switchgear into circuit, said engagement shaft being organized to pass from a position in which the engagement spring is relaxed, at least in part, to beyond a dead-center position in which the engagement spring is under stress; and a pawl mechanism organized to bear against the large toothed-wheel in a bearing position situated beyond the dead-center position in the predetermined direction of rotation and to release said engagement shaft to put said switchgear into circuit, wherein said mechanism which prevents jamming prevents the large toothed-wheel and small toothed-wheel from jamming after the engagement shaft has been released by the pawl mechanism.

12. A mechanism according to claim 11, wherein said first gap is provided in a zone of the large toothed-wheel which is situated close to said small toothed-wheel when the engagement shaft is bearing against the pawl mechanism.

13. A mechanism according to claim 10, wherein said second gap extends over a length that is slightly less than an integer number of gear pitch steps, and wherein said second retractable tooth has flanks which meet radially outwards at a second-retractable-tooth common edge, said second retractable tooth further including an inclined plane in a top zone adjacent to the second-retractable-tooth common edge.

14. A mechanism according to claim 13, wherein said second gap extends over a length that is approximately one-sixth of a gear pitch step shorter than an integer number of gear pitch steps.

15. A mechanism according to claim 14, wherein said second retractable tooth is followed in said predetermined direction of rotation by a third gap which extends over at least two gear pitch steps.

16. A mechanism according to claim 15, wherein said third gap is followed by a third tooth whose flanks meet radially outwards at a third-tooth common edge, said third tooth further including an inclined plane in a top zone adjacent to the third-tooth common edge.

17. A mechanism according to claim 13, wherein said second gap extends over a length that is approximately equal to 2% of a gear pitch step.

18. A mechanism according to claim 10, wherein said first gap is followed in the predetermined direction of rotation by n retractable teeth, each of the retractable teeth being retractable, along a radial axis extending through that tooth, against spring bias, and each of the retractable teeth being followed in said predetermined direction of rotation by a gap extending over at least two gear pitch steps.

19. A mechanism according to claim 18, said large toothed-wheel further including a first non-retractable tooth following the $n^{th}$ retractable tooth in the predetermined direction, wherein each of said retractable teeth and the first non-retractable tooth has flanks which meet radially outwards at a common edge, and includes an inclined plane in a top zone adjacent to the common edge.

20. A mechanism according to claim 19, wherein each one of said n retractable teeth is spaced apart from adjacent ones of said n retractable teeth by a gap extending over a length that is slightly less than an integer number of gear pitch steps.

* * * * *